343-872 SR
3/10/81 XR 4,255,752

United States Patent [19]
Noble et al.
[11] 4,255,752
[45] Mar. 10, 1981

[54] LIGHTWEIGHT COMPOSITE SLOTTED-WAVEGUIDE ANTENNA AND METHOD OF MANUFACTURE

[75] Inventors: Walter J. Noble, Valencia; John W. Small, Redondo Beach, both of Calif.

[73] Assignee: International Telephone and Telegraph Corporation, New York, N.Y.

[21] Appl. No.: 942,070

[22] Filed: Sep. 13, 1978

[51] Int. Cl.[3] ..... H01Q 13/10
[52] U.S. Cl. ..... 343/771; 343/872
[58] Field of Search ..... 343/770, 771, 873, 912, 343/915, 872

[56] References Cited

U.S. PATENT DOCUMENTS

| | | | |
|---|---|---|---|
| 2,826,524 | 3/1958 | Molloy | 333/248 |
| 2,948,896 | 8/1960 | Hart | 343/912 |
| 3,184,210 | 5/1965 | Fassnacht et al. | 343/912 |
| 3,335,419 | 8/1967 | Wyble et al. | 343/771 |
| 3,536,800 | 10/1970 | Hubbard | 343/912 |
| 3,648,172 | 3/1972 | Nakahara | 343/771 |

*Primary Examiner*—Eli Lieberman
*Attorney, Agent, or Firm*—William T. O'Neil

[57] ABSTRACT

A fiber reinforced composite structure for slotted type waveguide antenna, comprising at least one layer of conductive material applied over a mandrel by a known method. Radiating element slots are provided during this process and a laminate of low RF loss material is applied in layers of cloth made from aromatic polyamide fibers having a major fiber direction. A binder material, for example, an epoxy resin is applied and cured thereon as the layers are applied. Alternate cloth layers are applied with the major fiber direction rotated 90°. When the laminate is partially completed, two flanged stiffening ribs are typically placed longitudinally on the top and bottom of the waveguide structure along the surfaces other than that containing the slots. Additional layers of the laminate cover the stiffeners and thereby produce integral mounting structures. The waveguide interior is thereby environmentally sealed by the laminated covering, which also provides mechanical strength, and integral radar windows over the slot radiating elements.

10 Claims, 4 Drawing Figures

FIG. 3
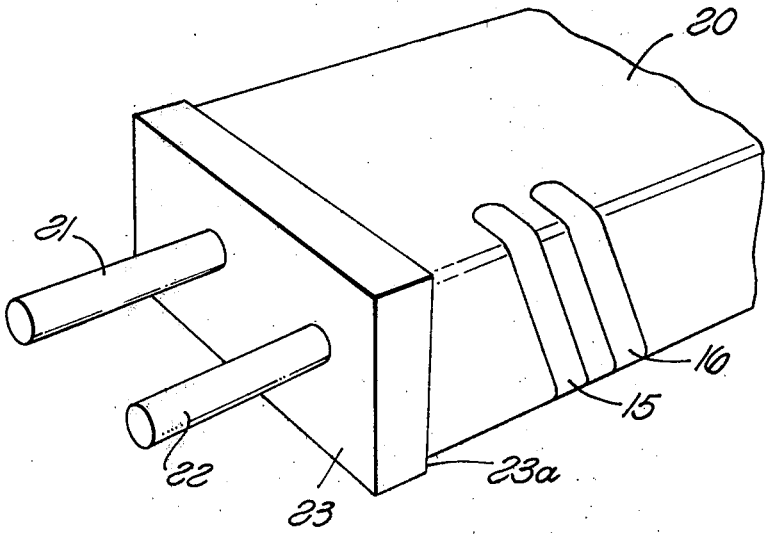
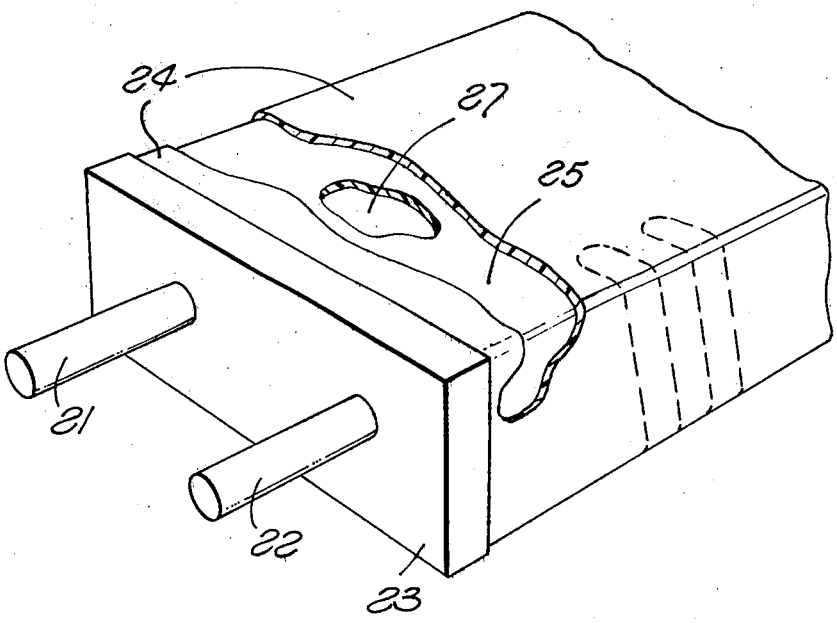
FIG. 4

LIGHTWEIGHT COMPOSITE SLOTTED-WAVEGUIDE ANTENNA AND METHOD OF MANUFACTURE

BACKGROUND OF THE INVENTION

1. Field of the Invention

The invention relates to slotted-waveguide microwave antennas generally.

2. Description of the Prior Art

In the prior art, waveguide antennas employing slots for radiating elements are of themselves well known. Basic waveguides have been manufactured as rectangular pipes or tubes dimensioned in accordance with the known criteria for the frequency band of interest. Alloys of copper have been extensively used as a waveguide material as has extruded aluminum. In order to manufacture a waveguide, slot-radiator antenna from such a waveguide, the slots must be individually and accurately machined into a wall of the guide. In the form of slotted-waveguide antenna illustrated herewith, a dual-slot configuration is contemplated. It is to be noted that alternate slot pairs are often differently oriented along the waveguide face, that fact further complicating the slotting process according to prior art methods and increasing the cost in terms of skilled labor. The dual-slot, radiating, waveguide antenna per se is known in the prior art and is described in U.S. Pat. No. 3,740,751, entitled "Wideband Dual-Slot Waveguide Array," as it might be manufactured according to known prior art techniques.

It is also to be understood that slotted-waveguide antennas are frequently used in planar arrays. It is not unusual for each length of waveguide in such an array to require as many as 164 slots in each of 50 or 100 stacked waveguides. Accordingly, it will be readily perceived that machining expense is very significant in the manufacture of a large planar array for a radar system.

It is well known that slotted waveguide antennas and arrays require environmental protection, that is the array slots must be covered with a dielectric material or radome which acts as a radio frequency window while excluding dust, moisture and other undesired foreign matter. In the prior art extruded metal waveguide arrangement this must be accomplished as a separate operation and structure. Such expedients as hand-applied dielectric tape or individually formed fiberglass radomes for each of the individual slotted waveguides have been employed for that purpose.

Still further, the fact that metallic waveguide, especially aluminum waveguide, even though finished with protective coatings, is ultimately subject to attack from various combinations of environmental conditions and for proper operation periodic refurbishment is required.

Yet again, the prior art extruded aluminum waveguide array is relatively heavy and when the planar array is mounted for rotation (about the vertical axis) a large mechanical drive and pedestal support is required when such arrays are mounted so as to avoid obstacles. This frequently means mounting at substantial elevation, for example at the top of a mast of a naval vessel. In such a situation it will readily be understood that reduction in weight is a matter of great importance.

Yet another consequence of the use of aluminum waveguide, which is extensively employed in slotted-radiator planar arrays currently, is the introduction of distortions to the array radiation pattern caused by the relatively high coefficient of thermal expansion of the metal. Very often, the environmentally imposed temperature differentials impose serious limitations on the performance of large planar arrays exposed to the environment. Even under what may appear to be a relatively uniform temperature condition, differences of several degrees over a large array are not uncommon due to micro-climatic affects of thermal eddies from ground or water and random cooling affects of wind gust. Radiant heat from the sun can also produce relatively severe temperature differentials in the antenna array itself and its backing and support structure. In addition to the foregoing, the prior art all-metal waveguide generally contains no integral provisions for mounting. Attachment methods currently employed include such expedients as clamping the waveguide elements to the backstructure by means of machined aluminum bars notched to accommodate the waveguide, a substantial number of such clamps being required across the face of a completed array each bolted to a similarly machined aluminum member which is a part of the backstructure. Due to the fact that the front clamps infringe into the radiating aperture of the array they cause distortion of the radiation pattern of the overall array in addition to adding significantly to overall weight.

The manner in which the present invention deals with the disadvantages of the prior art as aforementioned will be evident as this description proceeds.

SUMMARY OF THE INVENTION

In consideration of the disadvantages of the prior art, it may be said to have been the general objective of the present invention to provide multi-element slotted waveguide antennas which may be incorporated into planar arrays of radar systems, and which are lighter in weight, high in performance, and low in manufacturing cost. The objective is achieved through the use of "composite" techniques through which a waveguide antenna section is constructed with integral support means and greatly reduced weight and susceptibility to temperature and other environmental factors.

In accordance with the invention, slotted-waveguide members having predetermined patterns of radiating slots are fabricated from the "inside out" over a removable mandrel. The mandrel itself is a tool produced by known molding or machining processes and has outside dimensions matching the standard internal dimensions of the desired waveguide transmission line. In the electroplating or electroforming techniques (electrode-position) it is a standard procedure to apply a known material to the mandrel or core before it is plated with the desired metal or metals. The conductive layer then applied by selective plating and/or overall plating later photo etching to remove the conductive material in the slot areas, forms a conductive shell with inside dimensions determined by the mandrel outside dimensions. This conductive shell is of itself relatively fragile until the subsequent process steps involving the laminate buildup are completed to give the particular strength and rigidity which the structure of the invention achieves.

It should be observed at this point that the mandrel is adapted to be freely removable once the metal deposition is complete. Mandrel extraction may be facilitated in several known ways. One technique is the use of aluminum for the construction of the mandrel, fluid passages being provided therein so that application of a low temperature medium through the length of the mandrel will produce a sufficient temperature-induced shrinkage to permit extraction axially. Segmented mandrels which collapse by mechanical actuation are also possible, as are expendable mandrels which may be selectively "melted out" at a relatively low temperature.

In the selective plating process, a photographically produced mask facilitates the deposition of a "resist material" on the mandrel to avoid deposition of the plating material in the slot configuration.

The relatively thin, conductive shell formed as aforementioned may be a single layer of metal or may be a plurality of successively applied layers of the same or different materials. Environmental considerations, coefficients of expansion, and other purely mechanical and/or electrical considerations known in this art determine the layering of the conductive material or materials and the actual material applied. In one instance, a layer of gold followed by a layer of nickel and at least one layer of copper was used, the so-called selective plating processes being used in the deposition of these successive metallic layers. The "resist" material is equally effective in preventing the deposition of any of these metals in the intended slot areas.

A buildup of laminate consisting of a number of layers of low RF loss, high-strength plastic fibers preferably in a cloth form having a major or principal fiber direction is applied using a thermo-setting resin for bonding. The fibrous cloth is applied in layers with the major fiber direction of successive layers being rotated 90°. An integral stiffener and mounting bracket, for example, in the form of a tee or angle having a flange extending parallel and outward along the face of the waveguide, at least one such flange being in flat contact with the waveguide side, is affixed in the resin after about half of the layers have been applied. The remaining layers serve to over-bond this mounting bracket-stiffener. After heat and pressure curing according to well known principles for finishing of plastic-resin layups, the mandrel may be removed leaving a strong lightweight and economically produced slotted-waveguide antenna assembly. The thermo-setting resin and fiber laminate provides structural strength and rigidity for resistance to environmental effects and serves as a radar window over the radiator slots. The waveguide interior is also effectively environmentally sealed and inherently adapted for the introduction of gas pressurization.

The details of a typical embodiment according to the invention and further discussion as to structural, material and process aspects according to the invention will be evident as this description proceeds.

BRIEF DESCRIPTION OF THE DRAWINGS

FIG. 3 depicts a first process step in the manufacture of a slotted-waveguide antenna according to the invention illustrating the plating of the mandrel or core.

FIG. 4 illustrates the layup of the laminate layers over the conductive plating applied according to FIG. 3.

DETAILED DESCRIPTION

Figure 1:
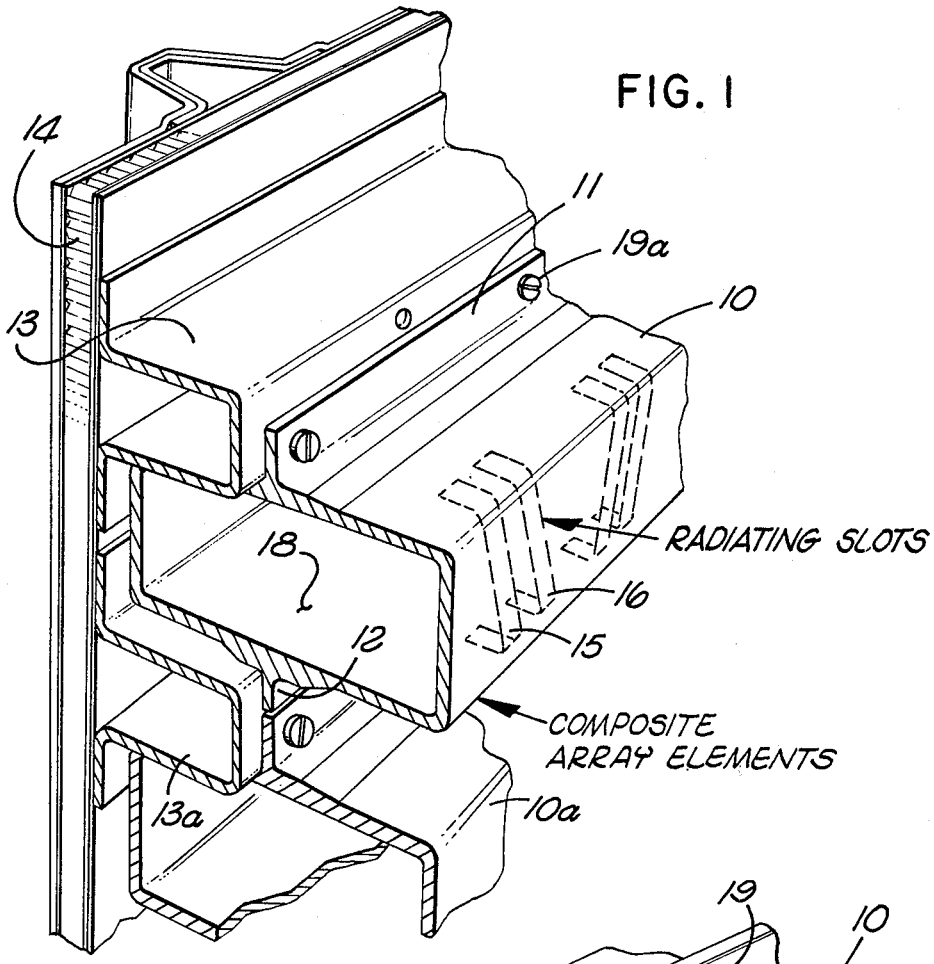
FIG. 1 is a partial view of a multi-element array showing two typical sections of slotted-waveguide antenna as they might typically be arranged in a planar phased array.

Referring now to FIg. 1, a fragmentary view shows how slotted-waveguide antenna sections according to the invention might typically be incorporated into a planar array. One such section of waveguide antenna is shown at 10 and another at 10*a*. Only the pertinent details for description are numerically identified in connection with waveguide antenna 10, however, it is to be understood that the corresponding parts of 10*a* are identical. The conductive interior layer 18 is as described, and insofar as electromagnetic energy within the waveguide is concerned functions substantially the same as if the entire guide wall were solid metal. The waveguide 10 is shown with the laminate buildup, so that typical radiating slots 15 and 16 are covered thereby, affording mechanical sealing but electro-magnetic transparency through these slots. The integral mounting rib 11 with a typical mounting hole 19*a* is shown with a bolt therein attaching the waveguide section 10 to a backup structure including hat-section structural stiffeners 13 and 13*a*. The lower stiffening rib 12 is similarly attached to hat-section member 13*a*, both hat sections being typically fixed to a honeycomb panel 14, whatever additional structure is required to mount the entire assembly being conventional.

It is to be understood that a planar array such as partially depicted in FIG. 1 could be mounted to rotate about an axis in either the horizontal or vertical plane. A typical planar array arrangement for a 3-dimensional scanning radar system involves mechanism for rotating the entire array about a vertical (or nearly vertical) axis to obtain a mechanical scan in the azimuth plane. The planar array would normally generate a pencil beam or beams which might otherwise be electronically scanned in the vertical plane and vernier sector scanned in the azimuth plane while the entire array is being rotated.

Figure 2:
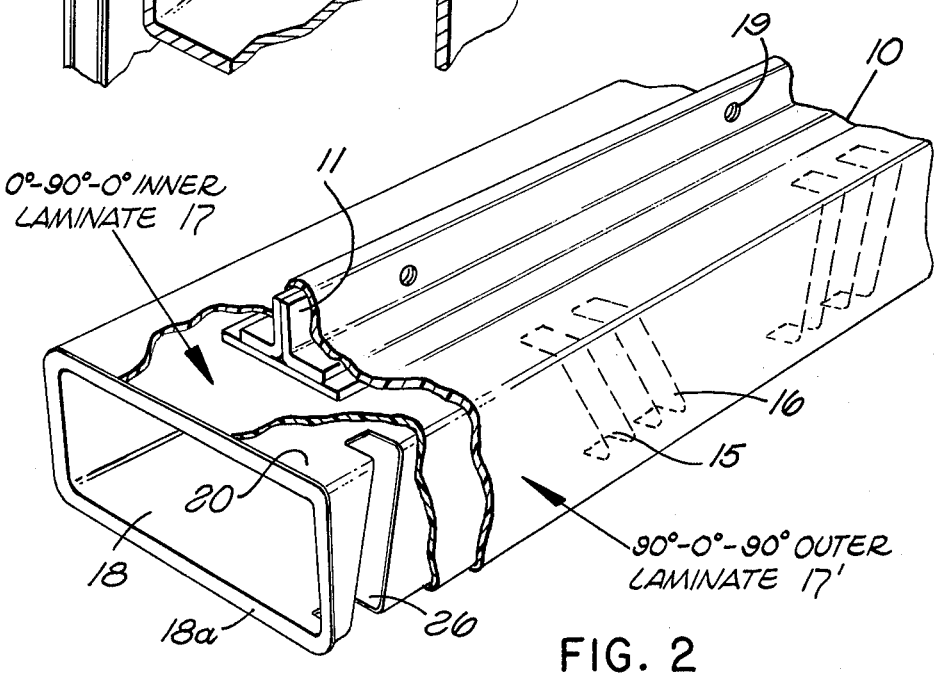
FIG. 2 is a partially cut-away drawing of a section of slotted-waveguide constructed in accordance with the invention.

Referring now to FIG. 2, a partial cut away of a typical waveguide antenna according to the invention is depicted, this being the element 10 as depicted in FIG. 1. The conductive layer 18, the outside surface of which is depicted at 20 in FIG. 2, will be discussed more fully as to its composition and method of deposition in connection with FIG. 3. For purposes of FIG. 2, this conductive layer contains a plurality of slot radiators. Slots 15 and 16 are fully covered in the cut-away view of FIG. 2 by the applied laminate, however slot 26 is shown as it would be expected to look without the laminate.

As will be seen in FIg. 2, an inner and outer laminate are preferably applied. This inner laminate 17 is depicted as involving 3 fiber layers with the thermosetting resin saturating the assembly. The inner layer is preferably 0°-90°-0°, which means the first layer has its major fiber direction running essentially longitudinally (axially) along the waveguide. The 90° fiber direction is of course orthogonal with respect to the first or 0° layer and a third layer reverts to this 0° fiber orientation.

After application of this inner laminate, the stiffener rib 11 shown as a tee section member is applied. The inner laminate layers may be cured before further steps are undertaken, in which case the stiffener rib will be placed with a coating of the thermo-setting resin over the cured inner laminate. Alternatively, it is possible to emplace the stiffener rib on the uncured surface of the inner laminate and proceed to apply the outer laminate in a 90°-0°-90° major fiber orientation sequence (three layers). This outer laminate 17 which extends over the stiffener rib and encases it with the waveguide structure may be separately cured in the event that the inner layer 17 had previously been cured.

The stiffener rib 11 is depicted as a fabricated tee section with flange portions in flat contact with a broad wall of the waveguide. It will be realized, however, that that particular structure is subject to variation as to the cross section shape of the stiffener rib and its precise location on the waveguide wall. Design considerations as to mounting, total strength required, etc., will determine the precise configuration and location of the stiffener rib. The mounting holes typically 19 are those depicted in FIG. 1, the bolt 19*a* passing through mounting hole 19 to bolt it to the hat section stiffener 13 which in turn is typically affixed to a "sandwich" type panel 14 as shown in FIG. 1.

Referring now to FIG. 3, a typical set up for the first fabrication step, namely, the plating (electrodeposition) of the conductive layer over a mandrel is illustrated. The mandrel itself is not visible, the metallic layer 20 covering it, however, an end plate 23 is visible and is a part of the mandrel assembly. The retangular dimensions of end plate 23 are oversize in respect to the cross-sectional dimensions of the conductive layer 20, thereby providing a lip 23*a* about the circumference of the conductive layer at that point. This facilitates the deposition of a radially outward continuation of the conductive layer 20 which can provide a conductive coupling flange facilitating the joining of the finished slotted waveguide antenna to inputs, outputs, and other antennas in an array. The mating RF "plumbing" parts are not shown in FIGS. 1 or 2, since they are not a part of the novel combination as such, and may be of conventional metal types, or may be composite types. Composite radio frequency "plumbing" parts which could facilitate the connection of the composite slotted waveguide antennas according to the invention into an array configuration are variously available commercially. Among the suppliers thereof are the firms of Chelton, Ltd. of Enavant House, Reform Road, Maiden Head, Berkshire in Great Britain and Gamma-f Corporation of El Segundo, Calif., U.S.A. Usually such parts are made with electroformed or foil type conductive layers over molds or mandrels with a strong lightweight material such as a graphite fiber epoxy material thereover. Although the graphite-fiber epoxy composite material is conductive, there is no requirement for radio frequency transparency in such parts as there is in the composite coating in the slotted-waveguide antenna assemblies according to the invention.

Referring again to FIG. 3, it will be noted that a pair of members 21 and 22 are illustrated, and these might be mandrel stiffening rods or actuating devices for a mechanically collapsible type of mandrel when the fully cured assembly according to the invention is ready for removal from the mandrel. Also 20 and 22 might be thought of as cold liquid input and output ports, where the temperature shrinkable mandrel concept is contemplated. The conductive layer 20 in FIG. 3 may actually be more than one layer, as for example the gold and copper layers hereinbefore mentioned as being typical of one embodiment.

Still further, the conductive layer 20 of FIG. 3 can actually be applied as a thin foil, the slots typically 15 and 16 being photo etched as they might be if nonselective plating or electroforming were employed as the metal deposition process step. As previously indicated, selective plating techniques can be employed so that the metallic layer is never deposited over the intended slot areas at any time.

Referring now to FIG. 4, a typical application of the laminate layers is depicted. Assuming that this is a 0°-90°-0° application, the first layer 27 will be (arbitrarily) understood to be the 0° layer, i.e., one in which the fibers of the cloth are running longitudinally with respect to the waveguide antenna. Layer 25 is next applied at 90° principal fiber direction and layer 24 subsequently is applied returning to the longitudinal fiber orientation. These three layers 24, 25, and 27 comprise the inner laminate 17 as illustrated in FIG. 2. The outer laminate 18 from FIG. 2 is applied in the same manner except that it is applied in a 90°-0°-90° sequence.

In both laminate applications, i.e., the inner and outer layers, the reinforcing cloth is impregnated and a suitable resin is used under, over and between the various layers. Curing is then effected according to known procedures for curing the particular resin applied. Ordinarily heat is applied, and preferably the so-called "vacuum bag" technique is employed to force out trapped air and excess resin from within the laminate and to insure complete penetration of the resin into the fibers of the reinforcing cloth.

Concerning materials, it is noted that a wide variety of materials are available, an engineering selection among the properties and costs thereof being appropriate for particular application. In a particular embodiment according to the invention the relatively high cost graphite fibers were used in fabricating the stiffener 11 with an epoxy resin used therewith. The stiffener and mounting bracket integral member 11 thus provides a relatively high order of strength to weight ratio for the inner and outer laminates. A cloth woven from aromatic polyamide fibers was used. Such cloth is available in single or multi-ply and may be applied with a binder resin in the wet, or B stage, which is a semi-cured condition of the epoxy binder resin. The aromatic polyamide fibers referred to are available under the name Kevlar, a DuPont fiber. The general purpose structural graphite fiber embedded in the epoxy resin in the stiffener mounting bracket member 11 is a commercial material available under the name Hercules type AS. The typical epoxy resin type 3501-6 is an amine-cured epoxy material rated for service up to 350° F.

The choice of the DuPont Kevlar 49 for the waveguide covering laminate was governed by its excellent electrical properties approaching those of quartz fiber, in addition to its high impact strength, moderate costs and near zero coefficient of thermal expansion. The strength-to-weight ratio of this composite material in its properly cured form is about ten times that of aluminum. Those properties are uniquely exploited in connection with the invention since the laminate layers have the multiple functions of waveguide structure, radome and protective sheath for the graphite/epoxy stiffener member 11 as well as the slots and interior of the waveguide itself.

The impact strength of the Kevlar/epoxy laminate is over eleven times that of graphite, six times that of boron and is actually above the range of S-glass or aluminum. This is due to the high ductility and high propagation energy of the fiber which allow it to maintain good load-carrying ability even after initiation of fracture. The more brittle materials, such as graphite tend to fail precipitously and thereafter provide almost no residual load-carrying capacity. Graphite fibers, being basically conductive, could not be used in the laminates, of course, since the electrical transparency of the laminate over the slot areas is vital.

The cured slotted-waveguide assembly according to the invention provides a strong, lightweight, and relatively inexpensive antenna. Incorporated into an array, there is a very significant weight advantage and excellent strength and resistance to environmental factors.

Resin material variations are available to the designer. For example, a polyester material can be used in lieu of the epoxy resin in applications where temperatures do not exceed 250° F. approximately. The epoxy resin aforementioned is effective up to 350° F. and therefore is resistant to solar heating. Still further, for very high temperature environments, i.e., in excess of 350° F. to approximately 700° F. a polyamide resin may be substituted if the higher cost can be justified on an environmental performance basis.

Performance of a planar array comprised of a relatively large number of individual waveguide antennas according to the invention performs exceptionally well electrically and in view of its stability and negligible coefficient of thermal expansion provides uniform and stable beam forming characteristics for such a planar array even in combinations of severe environmental conditions.

Other modifications and variations of the detailed structure and fabrication method described will suggest themselves to those skilled in this art and accordingly it is not intended that the scope of the invention should be limited to the drawings or this description, these being regarded as typical and illustrative only.

What is claimed is:

1. A light-weight, high strength, composite slotted-waveguide antenna comprising:

a thin, conductive, electro-deposited, inner wall having a predetermined pattern of slots therein forming the radiating elements of said antenna;

an outer shell over and adherent to the outer surface of said inner wall, said shell comprising a laminate of a plurality of layers of mutually adherent, low-loss fiber held in a cured, low-loss, thermosetting, plastic binder, said shell substantially completely covering said outer surface of said inner wall to provide an integral structure having mechanical strength and affording a sealed structure with radio frequency transmissability through said shell at said slots, and fibers of each of said layers being placed so said fibers of a given layer make a predetermined angle with respect to the fibers of each layer adjacent to said given layer.

2. Apparatus according to claim 1 in which said predetermined angle is substantially ninety degrees.

3. Apparatus according to claim 1 in which said waveguide is rectangular and said slots are substantially in a first lateral face of said waveguide, said apparatus including at least one flange running generally longitudinally along at least a second lateral face of said waveguide, said flange being at least partially embedded in said laminate to provide integral stiffening.

4. Apparatus according to claim 2 in which said fibers in each of said layers are contained in a woven cloth having a major fiber direction, said major fiber direction alternating between zero and ninety degree orientation in adjacent layers.

5. Apparatus according to claim 2 in which said plastic binder is an epoxy resin.

6. Apparatus according to claim 3 in which said flange is formed of graphite fibers in a resin binder.

7. Apparatus according to claim 1 in which said fibers are of aromatic polyamide material.

8. Apparatus according to claim 4 in which said fibers of said woven cloth are of aromatic polyamide material.

9. The process for fabrication of a lightweight slotted waveguide antenna with integral support structure, comprising the steps of:

forming at least one conductive layer by electrodeposition about a mandrel, said conductive layer providing the inside walls of said waveguide, said forming step further including the step of inhibiting deposition of said conductive layer in selected areas of said conductive layer to provide radiating slots;

applying over the outer surface of said conductive layer a plurality of layers of dielectric cloth each having a major fiber direction, with said major fiber direction of each layer at successively alternating angular orientations within each successive layer;

applying a thermosetting resin binder thereby producing a laminate transparent to radio frequency energy at said slots;

and curing said laminate to form a composite structure.

10. The process according to claim 9 in which said step of applying a plurality of layers is accomplished as an application of first and second laminations, each comprising a plurality of said layers applied discretely and successively.

* * * * *